United States Patent [19]

Hopperdietzel

[11] Patent Number: 5,044,104

[45] Date of Patent: Sep. 3, 1991

[54] LABEL MOUNTING APPARATUS

[75] Inventor: Siegfried Hopperdietzel, Selb, Fed. Rep. of Germany

[73] Assignee: Rehau AG & Co., Rehau, Fed. Rep. of Germany

[21] Appl. No.: 508,635

[22] Filed: Apr. 13, 1990

[30] Foreign Application Priority Data

Apr. 13, 1989 [DE] Fed. Rep. of Germany ..... 8904664

[51] Int. Cl.[5] ..... G09F 3/18

[52] U.S. Cl. ..... 40/642; 40/649; 40/661

[58] Field of Search ..... 40/649, 642, 650, 651, 40/652, 661, 658; 248/225.1, 417, 289.3, 223.4, 221.4

[56] References Cited

U.S. PATENT DOCUMENTS 3,582,170 8/1971 Schaeffer .
4,295,288 4/1981 Westberg .
4,557,064 10/1985 Thompson .
4,745,695 5/1988 Hetzer ..... 40/658 X

FOREIGN PATENT DOCUMENTS 243653 11/1965 Austria ..... 40/642
120099 7/1986 European Pat. Off. .
3515474 1/1986 Fed. Rep. of Germany .
3513199 10/1986 Fed. Rep. of Germany ..... 40/642
3513234 10/1986 Fed. Rep. of Germany ..... 40/642
2207539 2/1989 United Kingdom ..... 40/658

OTHER PUBLICATIONS

"Rehau Scanner Strips The Answer is clear", Rehau AG & Co., 4 pages.
"Profileguide", HV-Plast, (Aug. 1984) 2 pages.
Brochure, Aug. Fischer GmbH, 2 pages.
Catalog by Firma Werner Schenk GmbH & Co., cover page.

*Primary Examiner*—Kenneth J. Dorner
*Assistant Examiner*—J. Hakomaki
*Attorney, Agent, or Firm*—Spencer & Frank

[57] ABSTRACT

A label mounting apparatus includes a molding member which is mounted on a support, such as a shelf. The apparatus also includes an elongated carrier for labels corresponding to items on the support. To permit the carrier to be mounted on the molding member at a desired angle, detents are provided on the carrier and on the molding member or the corner of the support.

7 Claims, 7 Drawing Sheets

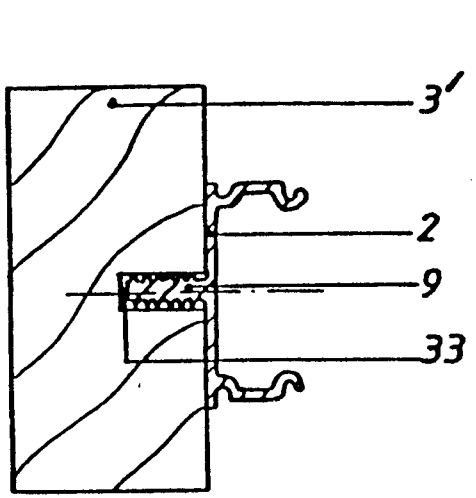
Fig. 2c
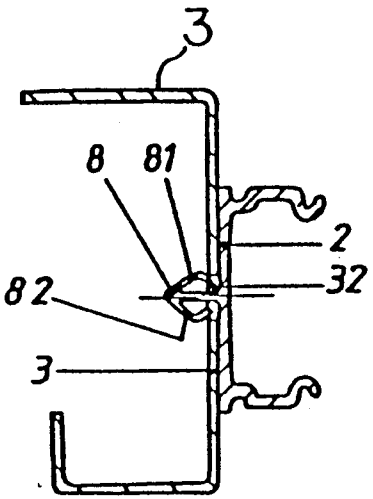
Fig. 2b
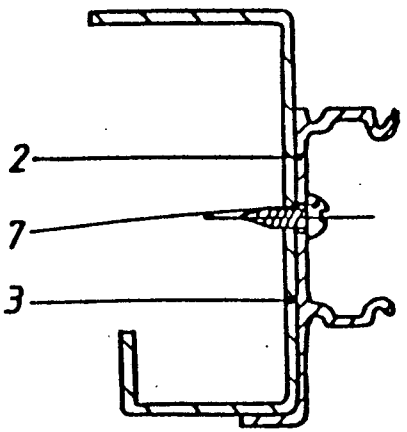
Fig. 2a
Fig. 2

LABEL MOUNTING APPARATUS

CROSS REFERENCE TO RELATED APPLICATION

This application claims the priority of Application Serial Number G 8904664, filed on Apr. 13th, 1989 in the Federal Republic of Germany, the subject matter of which is incorporated herein by reference.

BACKGROUND OF THE INVENTION

The present invention relates to an apparatus for mounting exchangeable information carriers such as labels on a support. The label mounting apparatus of the invention is of the general type that includes a carrier for the labels and fastening means for fixing the carrier to the edge region of a support such as a shelf, container, or the like. The carrier has a receiving pocket formed between a rear wall and a transparent front wall, with this receiving pocket accommodating the labels. The rear wall and the front wall are hinged together at their bases and the upper edge of the rear wall passes over the free edge of the front wall in a covering manner.

Such a mounting apparatus is disclosed in U.S. Pat. No. 4,295,288. In this prior art apparatus, the fastening means is composed, for example, of a latch strip which can be inserted into a latch groove at the edge regions of the shelves, containers, or the like. Connected in one piece with the fastening means is a covering strip for covering the edge regions of the shelves, containers, or the like as well as the rear wall and the front wall, which together form the receiving pocket for the labels. The rear wall and the front wall are hinged together at the base, for example by way of a film hinge, and the upper edge of the rear wall grips over the free edge of the front wall in a covering manner. The front wall can be released from this retention by a slight pressure, thus causing the receiving pocket to open for the insertion of a label. Thereafter, slight pressure against the rear wall closes the receiving pocket again, with the upper edge of the rear wall snapping over the free edge of the front wall and keeping it closed.

Also known in the art is the mounting apparatus disclosed in European Patent 0,203,209. This mounting apparatus is composed of a fastening strip and a covering strip which follows in one piece at the lower edge of the fastening strip and lies against the fastening strip. In order to insert a label or the like, this covering strip can be elastically moved away from the fastening strip. A cover is shaped to the upper edge of the fastening strip so as to project beyond the upper edge of the covering strip and serve as an arresting edge. In contrast thereto, the upper edge of the covering strip is configured as a shaped-on latch strip which forms a snap connection with the arresting edge of the fastening strip in that it engage underneath the arresting edge. The mounting apparatus is made of one piece of polymer material, with the covering strip being transparent and permitting proper viewing and reading of the label. In contrast thereto, the fastening strip may be made of an opaque plastic and its rear face is available as a fastening surface with which it can be glued, for example, to a shelf.

The prior art label mounting apparatuses are suitable for use with shelves in warehouses, storage facilities employing high shelf arrangements, and the like. However, they all have the drawback that they can be oriented in only one direction, so that the labels can only be read in one direction. This drawback is particularly serious if the label mounting apparatuses are to be used in variable ways, for example, if one wall of shelves is vertical but at another location such label mounting apparatuses are to be used, for example, in a given angular position.

SUMMARY OF THE INVENTION

The object of the present invention is to provide a label mounting apparatus which, due to its configuration, can be used in different angular positions. According to the invention, the carrier for the labels is mounted on an intermediate member or molding member that is equipped with at least one detent which communicates with a corresponding at least one detent associated with the carrier, so that the carrier can be fixed at defined angular positions.

The molding member according to the invention makes it possible to use one and the same carrier at various locations, with the carrier being oriented at different angles. Due to this flexibility in use, a separate carrier is not required for each angular position.

Advantageously, the carrier has a U-shaped profile and is provided on the exterior of the free U legs with groove-shaped detent recesses. Detent tabs are provided at the free ends of webs projecting from the rear wall of the carrier, and these detent tabs can be selectively engaged in the detent recesses of the molding member so as to position the carrier at a desired angle. However, the molding member may also be a C-shaped member having a rounded outer circumference, with the detent recesses being provided in the outer surface of the C-shaped member.

The space required by the molding member, between the support on which it is mounted and the rear wall of the carrier, is advisably covered by a flexible sealing strip made in one piece with the upper edge of the rear wall. This cover is configured in such a way that the space is covered by the sealing strip in all settable angular positions of the carrier.

In another embodiment of the label mounting apparatus according to the invention, an L-shaped molding member is connected to the upper edge of the rear wall of the carrier by way of a continuous flexible strip. The short arm of the L-shaped molding member passes under the lower edge of the support while the long arm of the L is mounted on the support. The detents serving to define the angular positions of the carrier are provided on the lower free arm of the molding member and on a detent arm extending from the rear wall of the carrier.

BRIEF DESCRIPTION OF THE DRAWINGS

FIG. 2*a* and 2*c* are sectional views showing the various ways the molding member in the embodiment of FIGS. 1*a* -1*c* can be fastened to the support.

DESCRIPTION OF THE PREFERRED EMBODIMENTS

Figure 1A:
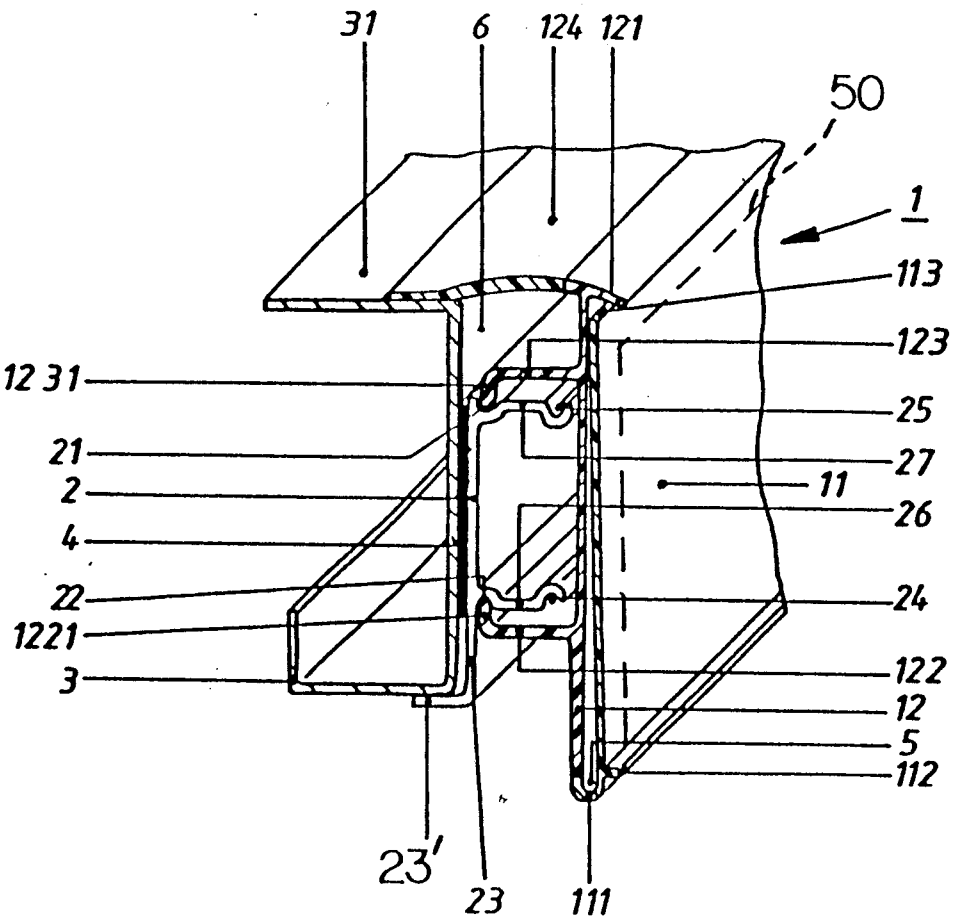
FIGS. 1*a* to 1*c* are perspective views showing a label carrier in various angular positions in one embodiment of the label mounting of the present invention.

In FIG. 1*a*, a label mounting apparatus in accordance with a first embodiment of the present invention includes a carrier 1 and a molding member 2 on which the carrier 1 is adjustably mounted. The carrier 1 is shown in its vertical position. The transparent front wall 11 of carrier 1 is connected in one piece with the rear wall 12 of carrier 1 by way of a flexible movement-permitting portion 111 configured as a film hinge. In the region of portion 111, approximately at a right angle to the front wall 11, a continuous guide strip 112 is provided to serve as a support for a bar-code scanning wand (not illustrated).

An edge strip 121 which grippingly overlaps the free upper edge 113 of front wall 11 is provided at the upper end of rear wall 12. Webs 122 and 123 project from rear wall 12 at almost a right angle to the rear wall. The free ends of webs 122 and 123 are angled to provide detent tabs 1221 and 1231. Detent tabs 1221 and 1231 are engaged in detent grooves 21 and 22 formed in molding member 2. Molding member 2 is held at support 3 (such as a shelf) by way of a layer of adhesive 4. To better fix it, the bottom wall of molding member 2 is provided with an extension 23. This extension 23 is bent at its free end 23' and thus grips underneath the associated edge of support 3.

Front wall 11 of carrier 1 can be folded outward so that a label 50 can be inserted or removed from the pocket 5 formed between front wall 11 and rear wall 12. Label 50 may, for example, depict the price and other information about items (not illustrated) positioned on support 3. The label 50 may also include a bar code (not illustrated) that is located near guide strip 112 when label 50 is deposited in the pocket 5.

Carrier 1 may be made by extrusion of polyvinyl chloride. An inherent characteristic of the extrusion process is that extruded surfaces may have tiny horizontal grooves. As a result, the inner and outer surfaces of front wall 11 may not be optically flat over the regions of the bar codes (e.g., adjacent guide strip 112). These minute grooves may cause irregular reflections from the inner and outer surfaces of wall 11 as the bar codes are scanned, such irregular reflections corresponding to "noise" and causing a deterioration in the reading rate and accuracy. German patent application P 39 14 319.8, filed Apr. 29th, 1989, teaches that these irregular reflections can be reduced by mechanically treating the outer surface to provide a very slight degree of roughness—what might be called "microroughness." However the German application also teaches that a special composition may be used for the transparent polyvinyl chloride to reduce irregular reflections; this composition is preferably used for the polyvinyl chloride that is extruded as front wall 11. An example of a suitable composition is as follows: 100 parts by weight of polyvinyl chloride having a K value of 57; two parts by weight of tin stabilizer; 1.5 parts by weight polymethyl methacrylate as a flow modifier; and 1.2 parts by weight of a sliding agent mixture of fatty alcohols, wax esters, and oxidized polyethylene.

In the upper region of rear wall 12, following gripping edge 121, a cover strip 124 with a flexible portion is provided. In the illustrated embodiment, strip 124 sealingly lies against the upper wall 31 of support 3.

Figure 1B:
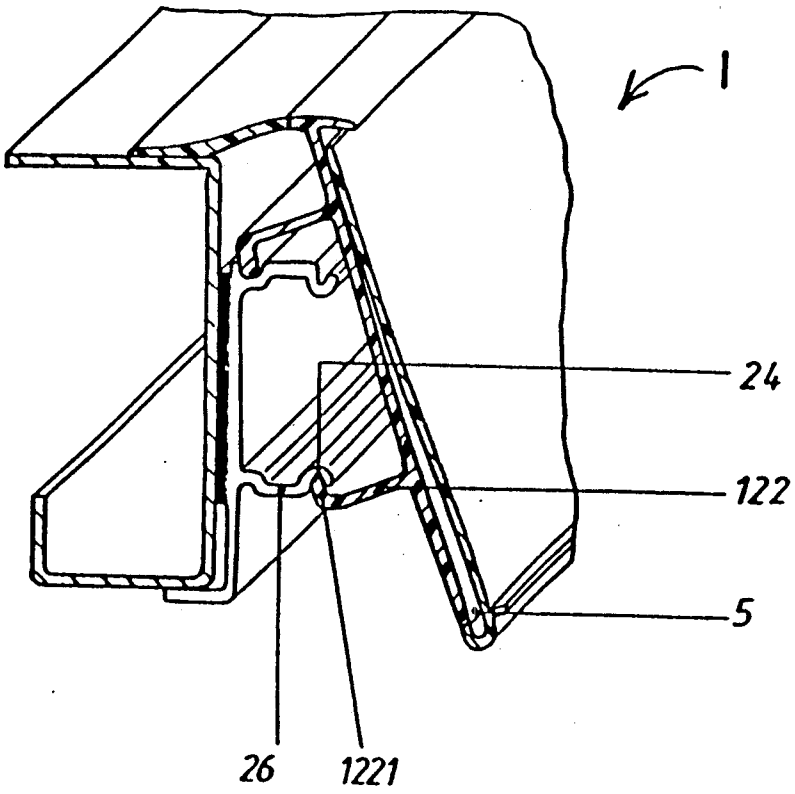

FIG. 1*b* shows the carrier 1 in a different angular position. The detent tab 1221 now engages in detent groove 24 at the lower arm 26 of molding member 2. All other reference numerals correspond to those of FIG. 1. In FIG. 1*b*, carrier is inclined upwardly by approximately 30° compared to the illustration in FIG. 1*a*. In this way, one and the same carrier can be used to identify the material on shelves near the floor by revealing their inscriptions without the viewer having to bend down to see the inscriptions.

Figure 1C:
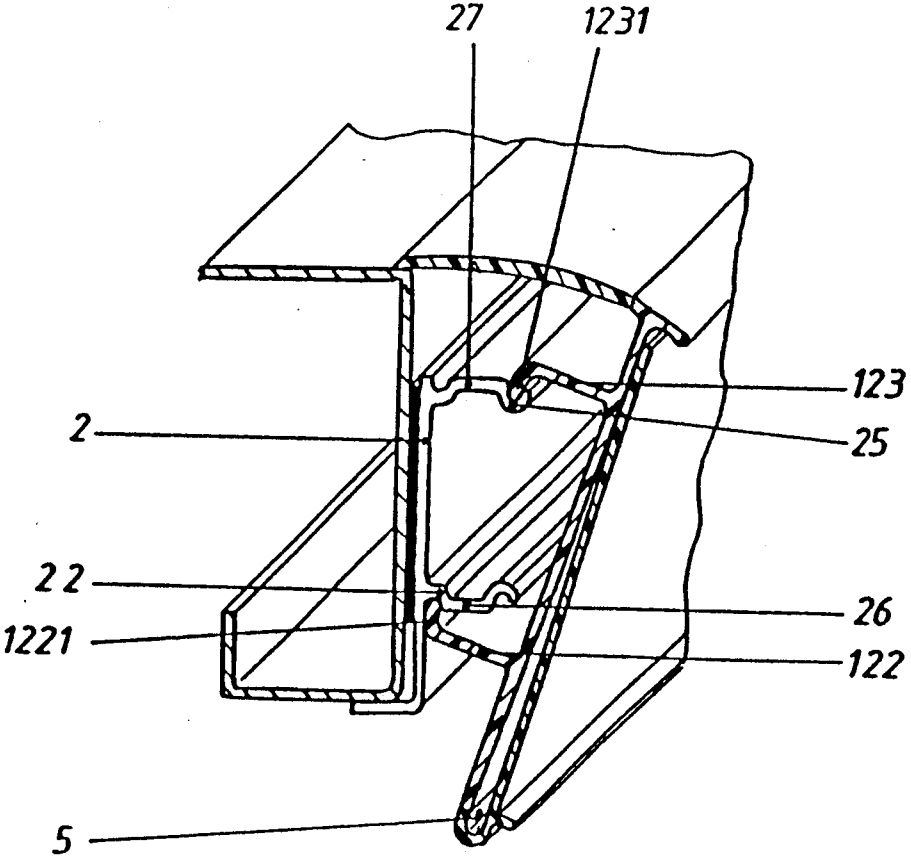

FIG. 1*c* shows the reverse of the detent engagement shown in FIG. 1*b*. Now, detent tab 1221 engages detent groove 22 of lower arm 26 of molding member 2. However, detent tab 1231 engages the front detent groove 25 of upper arm 27. In this way, an angular position of approximately 30° relative to the initial position shown in FIG. 1*a* is achieved. Labels placed into receiving pocket 5 can thus be read if the carrier 1 is positioned above eye level.

Figure 1D:
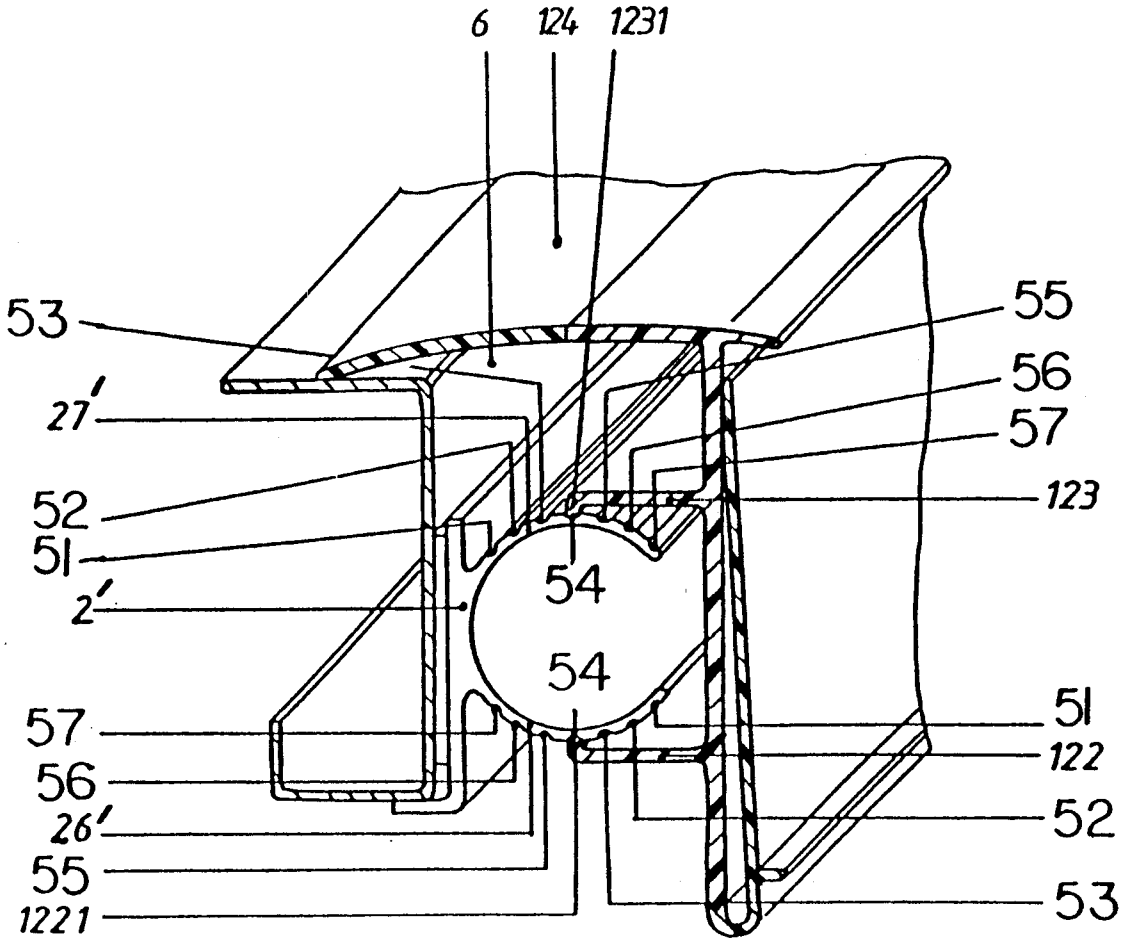
FIG. 1*d* is a perspective view showing another embodiment.

FIG. 1*d* shows a special embodiment of a carrier member 2' which, in contrast to the above-described examples, no longer has a U-shaped profile but instead a profile which corresponds to the letter C. The arms 26' and 27' of the C have detent grooves 51–57 on their exterior surfaces to latchingly engage the detent tabs 1221 and 1231. The embodiment of FIG. 1*d* has more possible variations in angular position than the above described embodiment of FIGS. 1*a* to 1*c*. In all cases, coverage of space 6 required by molding member 2 is ensured by flexible sealing strip 124.

FIGS. 2*a*–2*c* show various fastening possibilities for molding member 2. For example, FIG. 2*a* shows a screw 7 which, depending on the location of use, may be a wood screw or a metal screw. FIG. 2*b* shows a latching clip 8 which engages support 3 through an opening 32 and grips behind this opening with its detent sleeves 81 and 82 so as to provide a hold. FIG. 2*c* shows a fastening shaft 9 connected directly to molding member 2 and inserted, for example, into a groove 33 in a wooden support 3'.

Figure 3A:
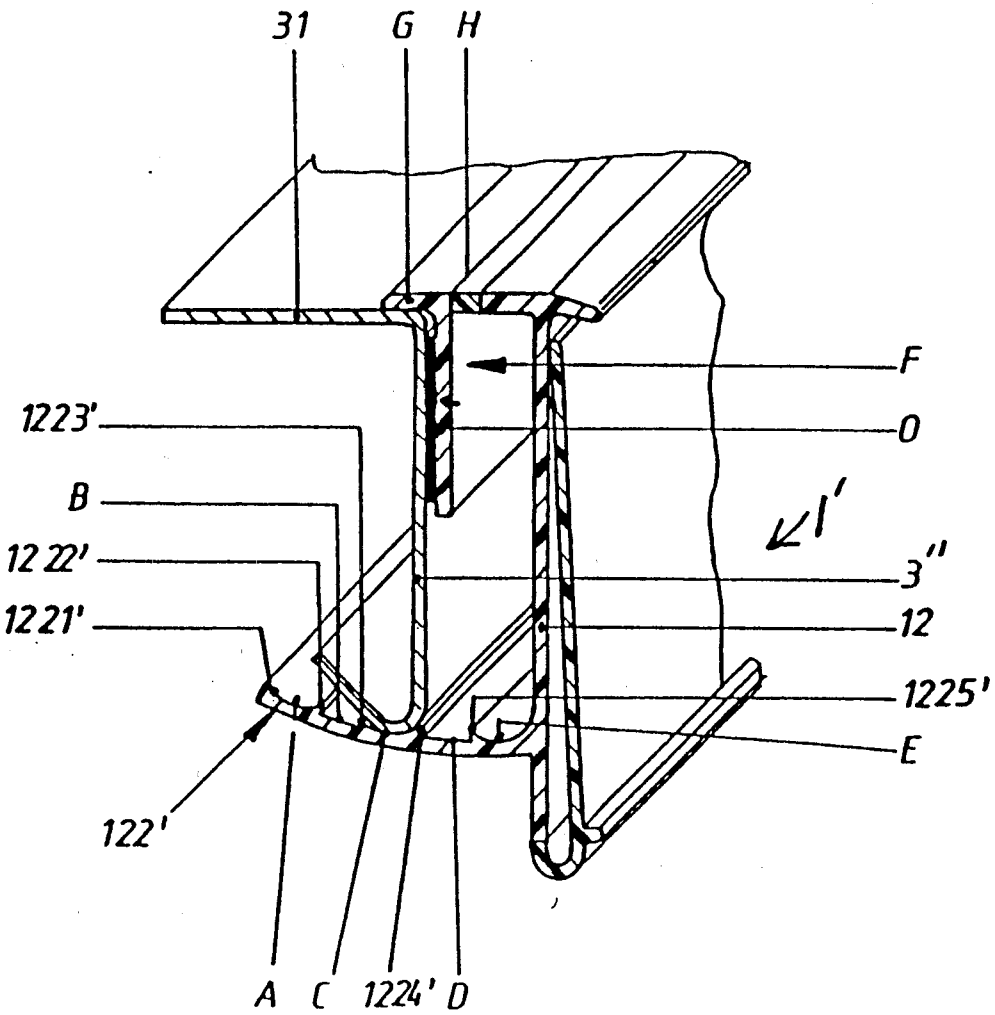
FIGS. 3*a* and 3*b* are perspective views showing further embodiments.

In the embodiment of FIG. 3*a*, only one fastening web 122' projects from rear wall 12 of carrier 1'. This fastening web 122' is provided with a plurality of raised detents 1222', 1223', 1224' and 1225' at its interior surface 1221'. These raised detents provide detent grooves A, B, C, D and E which, in turn, serve as detent engagements for the lower corner of support 3''.

The long arm O of an L-shaped molding member F is fixed to support 3'' by way of, for example, adhesive tape. The short L-arm G grips over the associated upper wall 31 of support 3''. The L-shaped molding member F is articulated, by way of a continuous strip H having a flexible portion, with the upper edge of rear wall 12. The lower corner of support 3 provides a detent which engages in one of the detent grooves A, B, C, D, or E, depending on the selected angular position for carrier 1', and retains the carrier 1' in the selected position.

Figure 3B:
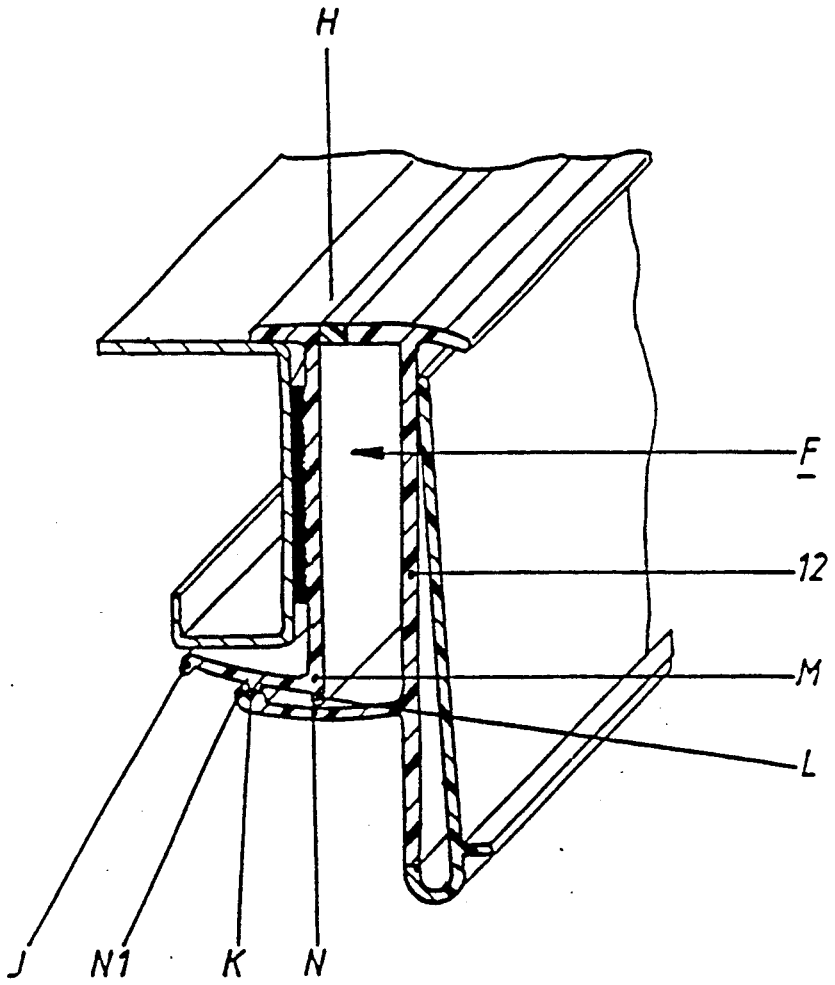

FIG. 3*b* shows a variation on the embodiment of FIG. 3*a*. Detents J, K, and L are provided at the lower free end M of an L-shaped molding member F. A detent arm N extending from rear wall 12 terminates in an enlarged portion having a detent groove N1.

It will be understood that the above description of the present invention is susceptible to various modifications, changes, and adaptations, and the same are intended to be comprehended within the meaning and range of equivalents of the appended claims.

What I claim is:

1. An apparatus for mounting a label on a support, comprising:

a molding member connected to the support, the molding molding having first means for providing a plurality of molding detents; and a carrier mounted on the molding member, the carrier having a rear wall with a bottom portion and an upper edge, a transparent front wall with a bottom portion that is connected to the bottom portion of the rear wall, and a pocket between the front and rear walls for receiving the label, the carrier additionally having second means extending from the rear wall for providing at least one carrier detent which is selectively engageable with one of the molding detents so as to selectively set the carrier at one of a plurality of angles, and a strip which is connected to the upper edge of the rear wall and which extends over the molding member to the support, the strip being made in one piece with the rear wall and having a flexible portion.

2. The apparatus of claim 1, wherein the second means comprises a plurality of webs extending from the rear wall of the carrier, and detent tabs on the webs, wherein the molding member comprises a back wall which is connected to the support, and wherein the first means of the molding member comprises two side walls extending from the bottom wall at spaced-apart positions, the side walls having grooves which constitute the molding detents, the side walls and back wall of the molding member being generally U-shaped in cross-section.

3. The apparatus of claim 1, wherein the second means comprises a plurality of webs extending from the rear wall of the carrier, and detent tabs on the webs, wherein the molding member comprises a base portion which is connected to the support, and wherein the first means of the molding member comprises two arcuate side walls extending from the base portion at spaced-apart positions, the side walls having grooves which constitute the molding detents.

4. The apparatus of claim 1, wherein the strip covers the molding member when the carrier is at any of the plurality of angles.

5. The apparatus of claim 1, wherein the molding member comprises a wall which is mounted on the support, the wall having top and bottom ends, wherein the first means of the molding member comprises another wall which is connected to the wall at the bottom end thereof, the molding detents being disposed at spaced apart positions on the another wall, wherein the second means of the carrier comprises an arm extending from the rear wall of the carrier and terminating in the at least one carrier detent, and wherein the strip is connected to the top end of the wall of the molding member.

6. The apparatus of claim 1, wherein the bottom portions of the front and rear walls of the carrier are connected in the manner of a hinge, wherein the front wall of the carrier has a free upper edge, wherein the rear wall has an upper edge, and wherein the carrier further comprises a cover attached to the upper edge of the rear wall, the cover extending grippingly over the free edge of the front wall.

7. An apparatus for mounting a label on a support having a lower corner, comprising:

a molding member which is connected to the support, the molding member having a top end;

a strip connected to the top end of the molding member, the strip having a flexible portion; and a carrier having a rear wall with a bottom end and with a top end that is connected to the strip, a transparent front wall with a bottom end that is connected to the bottom end of the rear wall, and a pocket between the front and rear walls for receiving the label, the carrier additionally having an arm extending from the rear wall, and means carried by the arm for providing a plurality of carrier detents which are selectively engageable with the lower corner of the support so as to selectively set the carrier at one of a plurality of angles.

* * * * *